US005526550A

United States Patent [19]

Huang

[11] Patent Number: 5,526,550

[45] Date of Patent: Jun. 18, 1996

[54] MULTI-PURPOSE ADJUSTABLE TIE HOLDER STRUCTURE

[76] Inventor: Yu-Lin Huang, 1F, No. 2 Lane 319, Hsin-Yi Rd., Lu Chow Hsiang, Taipei Hsien, Taiwan

[21] Appl. No.: 382,170

[22] Filed: Feb. 1, 1995

[51] Int. Cl.[6] ..... A44B 6/00

[52] U.S. Cl. ..... 24/66.2

[58] Field of Search ..... 24/49.1, 66.2, 24/66.4, 66.5, 66.7, 66.8, 66.9, 66.11, 66.13; D11/202

[56] References Cited

U.S. PATENT DOCUMENTS

| | | | |
|---|---|---|---|
| 1,707,759 | 4/1929 | Young | 24/66.4 |
| 1,990,720 | 2/1935 | White | 24/66.2 |
| 2,039,022 | 4/1936 | Mix | 24/66.2 |
| 2,060,040 | 11/1936 | Cobb | 24/66.2 |
| 2,195,594 | 4/1940 | Kreisler | 24/66.2 X |
| 2,465,787 | 3/1949 | Bliek | 24/66.2 |
| 2,585,603 | 2/1952 | Vaisey et al. | 24/66.2 |
| 4,686,716 | 8/1987 | Burns | 24/66.2 X |

*Primary Examiner*—James R. Brittain
*Attorney, Agent, or Firm*—Bacon & Thomas

[57] ABSTRACT

A multi-purpose adjustable tie holder structure including a clasp arrangement, a hanger and ornamental chains. The clasp arrangement is provided with a clasp element on the rear side thereof. The hanger is joined to an upper side of the clasp arrangement. A left arm and a right arm are accommodated within a shell of the clasp arrangement and respectively project from the opposite ends of the shell. The left and right arms may be extended from or retracted into the shell. Through holes are provided in an end portion of the left and right arms respectively for insertion of the ornamental chains.

5 Claims, 6 Drawing Sheets

MULTI-PURPOSE ADJUSTABLE TIE HOLDER STRUCTURE

BACKGROUND OF THE INVENTION

The present invention relates generally to a tie holder structure, and more particularly to a multi-purpose adjustable ornamental tie holder.

Tie holders are used to keep ties neatly in place on the shirt, and they may also be provided with glossy chains for positioning and ornamental purposes. FIG. 1 is a schematic view of a conventional tie holder described in U.S. Pat. No. 2,037,864. The disclosed tie holder mainly comprises a clasp 50 and an adjustable member 60 having its opposite ends respectively connected to the opposite ends of a flexible or chain member 70. The tie holder is adapted only for clasping the necktie onto the shirt. And when the tie holder is positioned on a shirt 8, the length of the chain member 70 may be adjusted by means of the adjustable member 60 from one side thereof. After being adjusted, the tie holder may easily cause the tie to incline to one side since adjustment of the flexible or chain member 70 is only possible from one side.

SUMMARY OF THE INVENTION

The primary object of the present invention is to provide a multi-purpose tie holder structure wherein the tie holder may be used to clasp the necktie onto the shirt or it may be suspended by a shirt button, and the necktie is kept in place by ornamental chains the length of which is adjustable by means of a clasp means.

BRIEF DESCRIPTION OF THE DRAWINGS

The foregoing and other features and advantages of the present invention will be more clearly understood from the following detailed description and the accompanying drawings, in which.

FIG. 6 is a top view of the clasp means shown in FIGS. 4 and 5;

DETAILED DESCRIPTION OF THE PREFERRED EMBODIMENT

Figure 2:
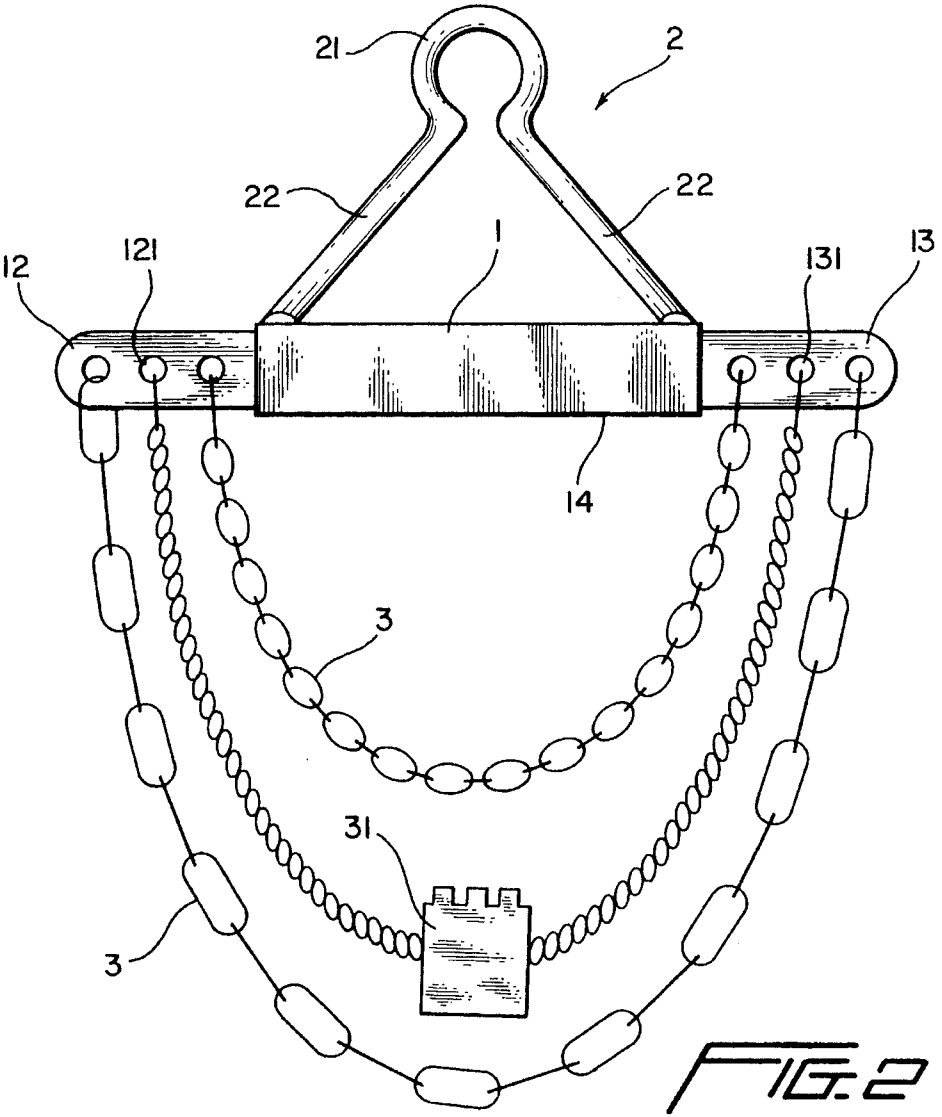
FIG. 2 is a schematic view of the outer appearance of the present invention.
Figure 1:
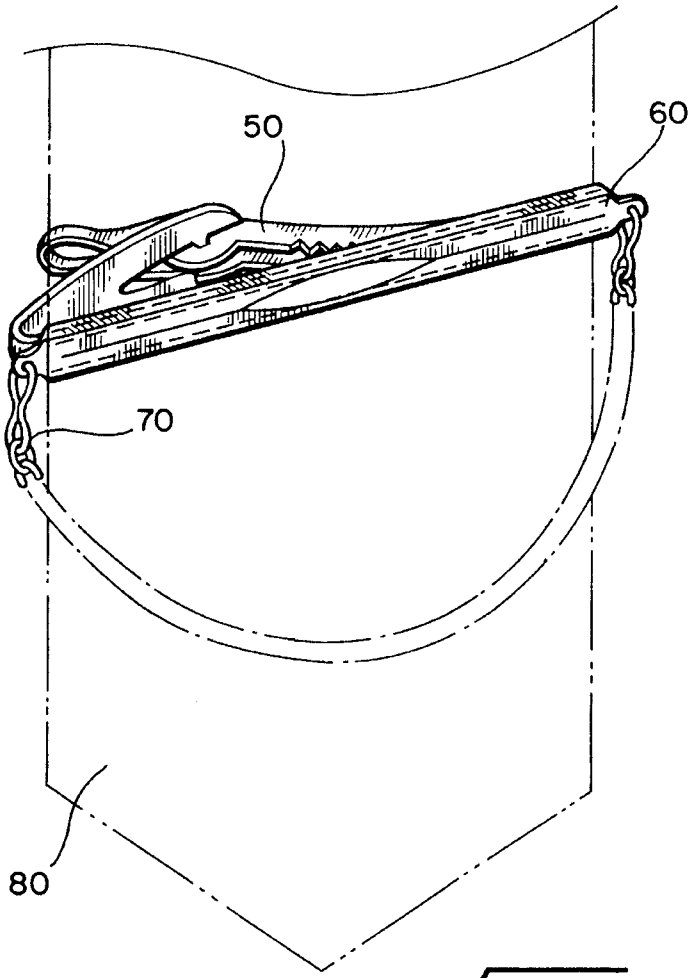
FIG. 1 (PRIOR ART)
FIG. 1 is a schematic view of the prior tie holder disclosed in U.S. Pat. No. 2,037,864.
Figure 7:
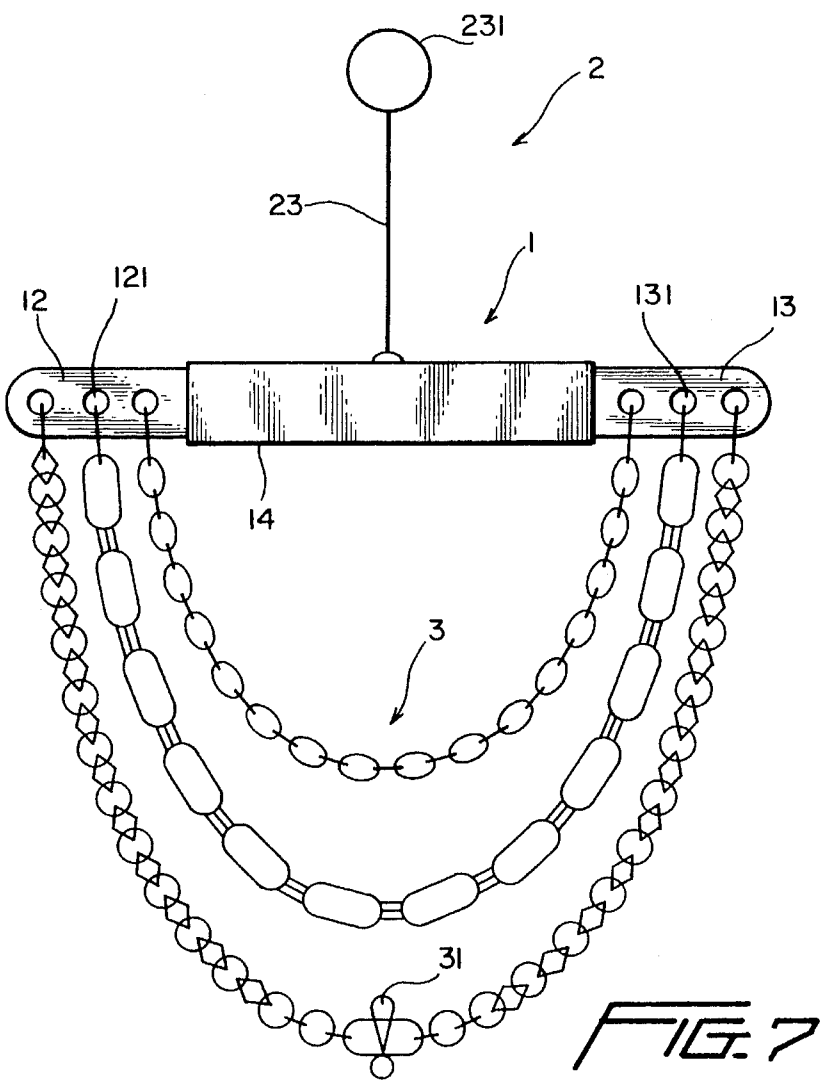
FIG. 7 is an outer view of the flexible hanger of the present invention.
Figure 3:
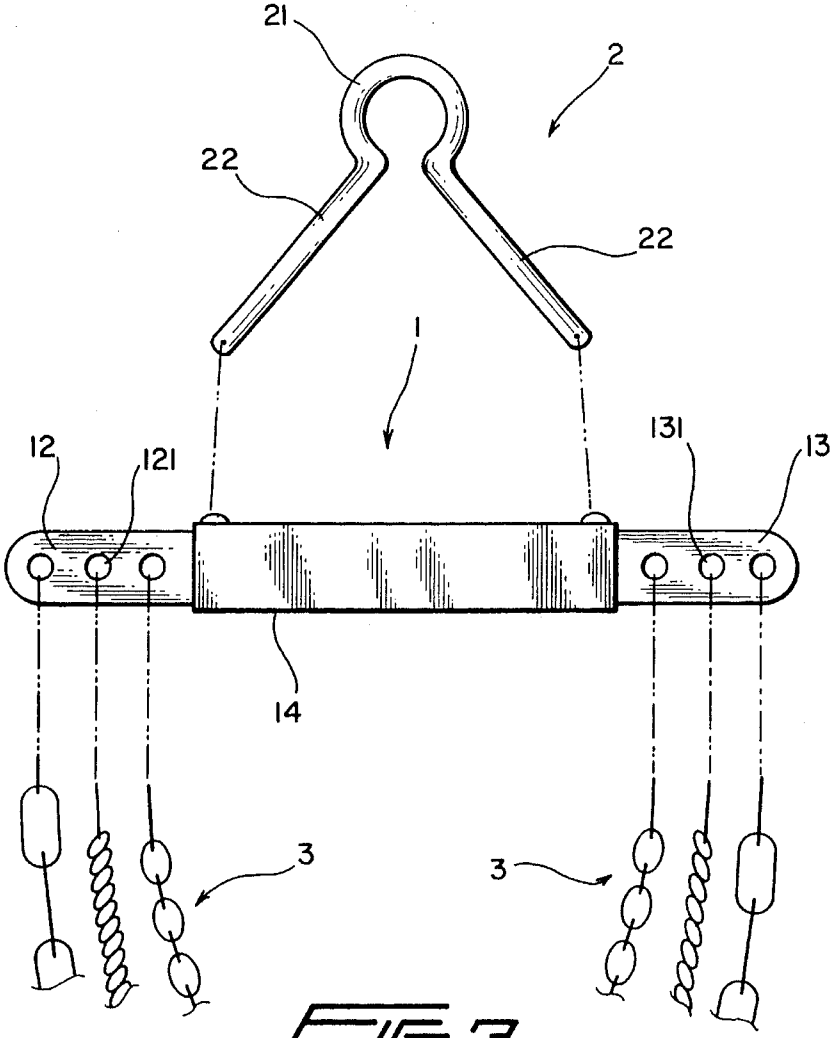
FIG. 3 is an exploded view of the tie holder structure of the present invention.
Figure 4:
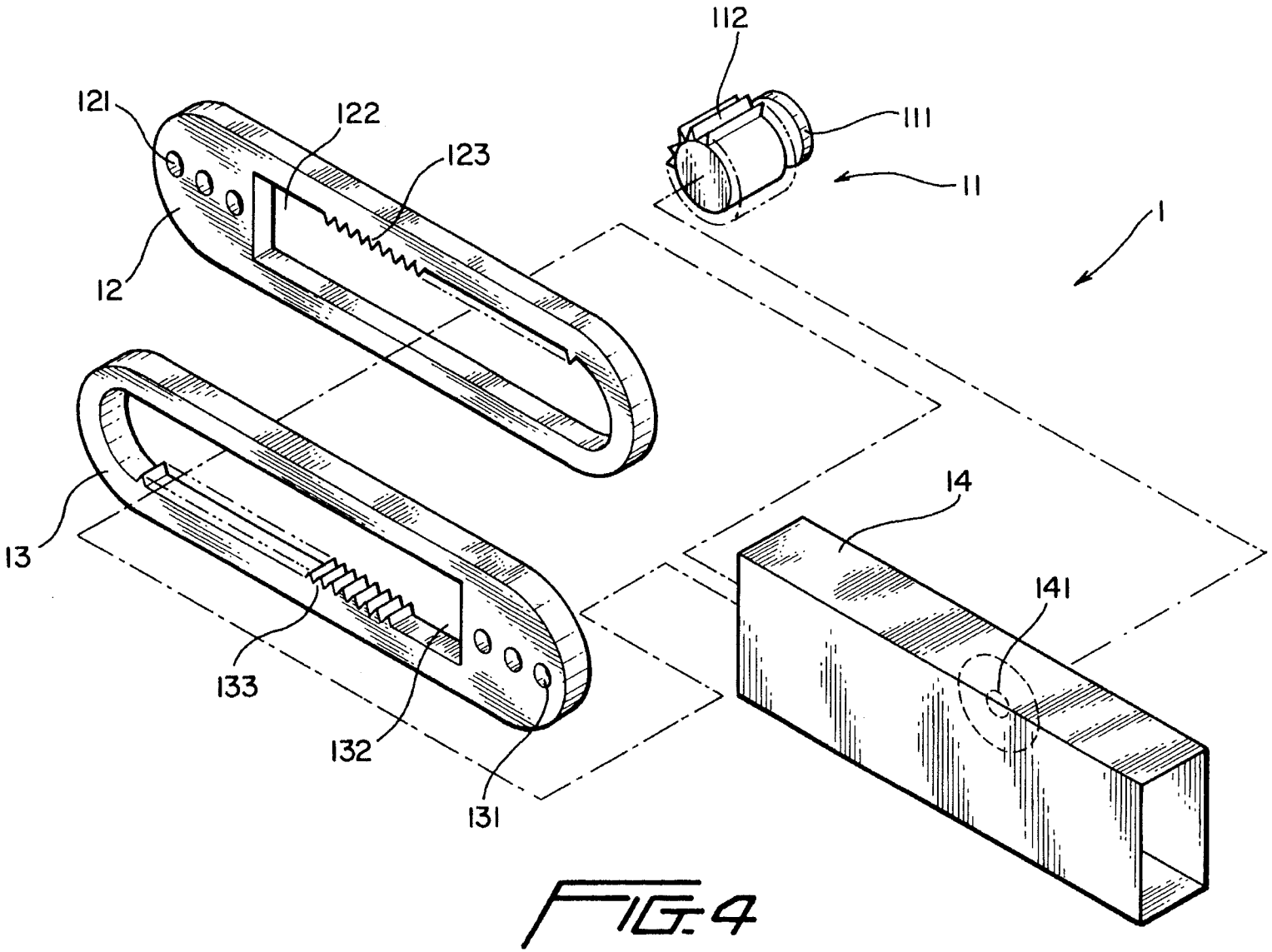
FIG. 4 is an exploded view of the clasp means of the present invention.
Figure 12:
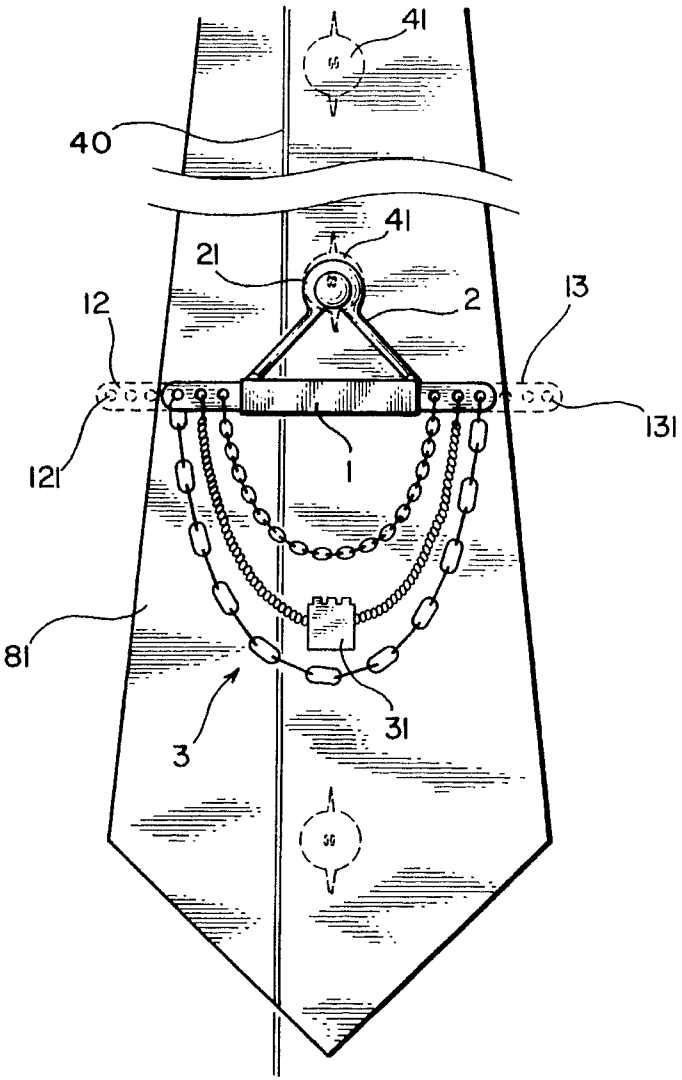
FIG. 12 a schematic view showing adjustment of the length of the flexible chain of the present invention when in use.
Figure 8:
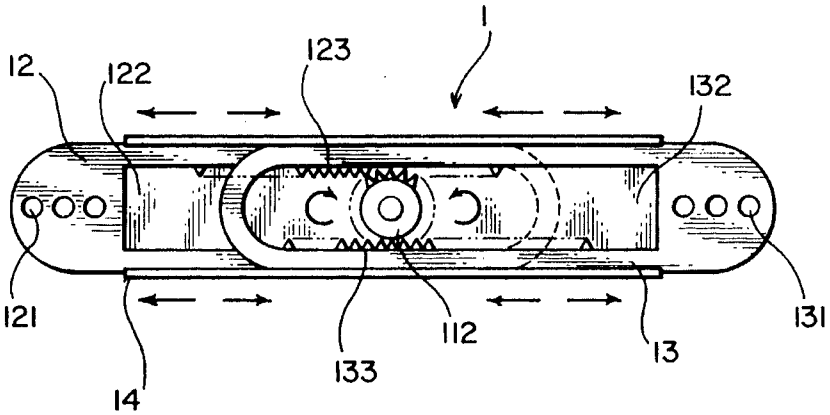
FIG. 8 is an outer view of the semi-fixed hanger of the present invention.
Figure 5:
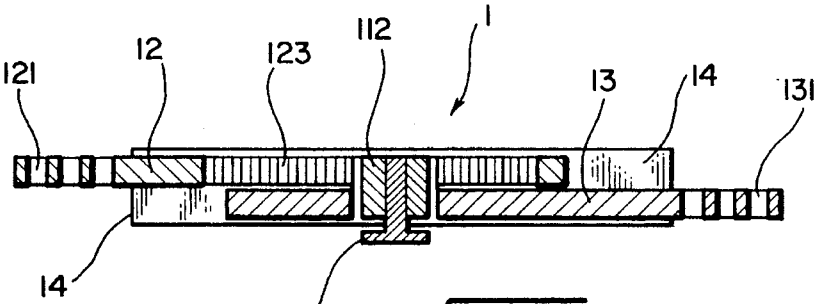
FIG. 5 is a sectional view of the clasp means of the present invention in an assembled state.
Figure 9:
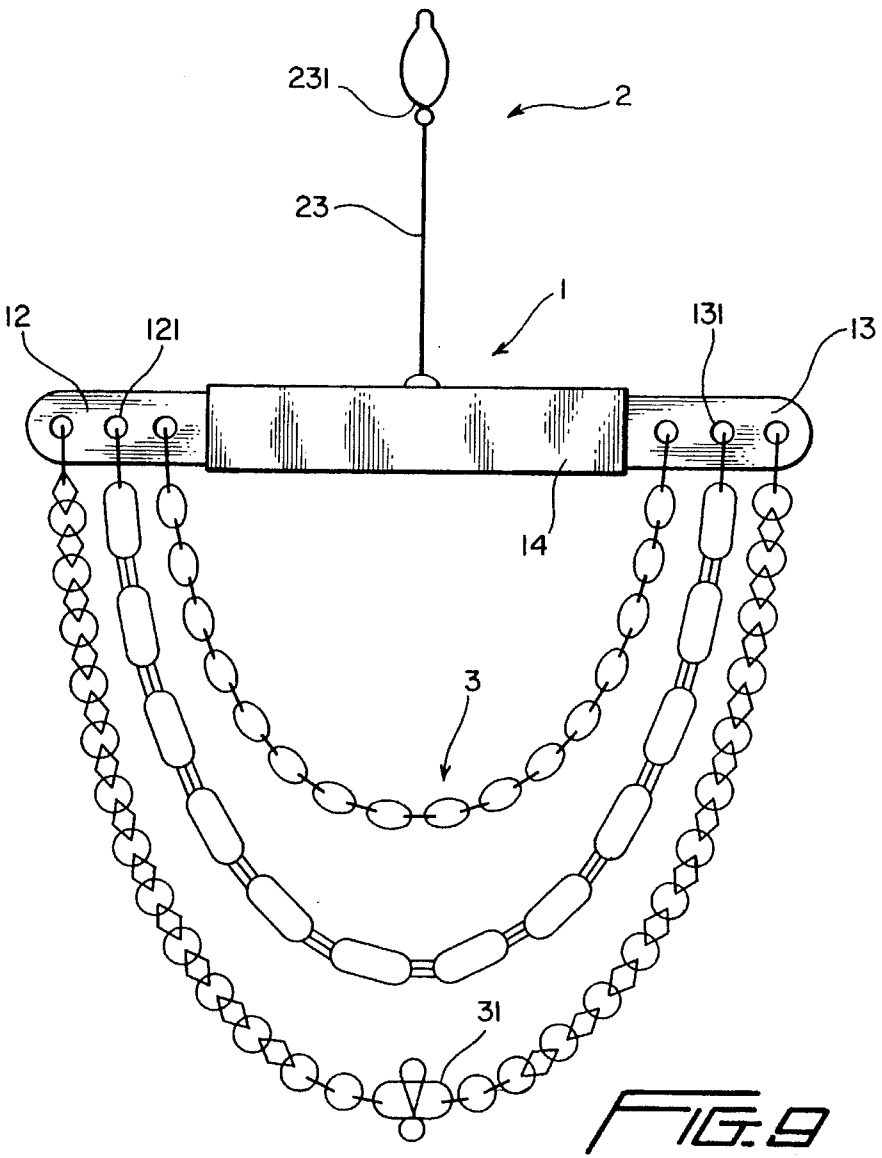
FIG. 9 shows another preferred embodiment of the present invention.
Figure 8:
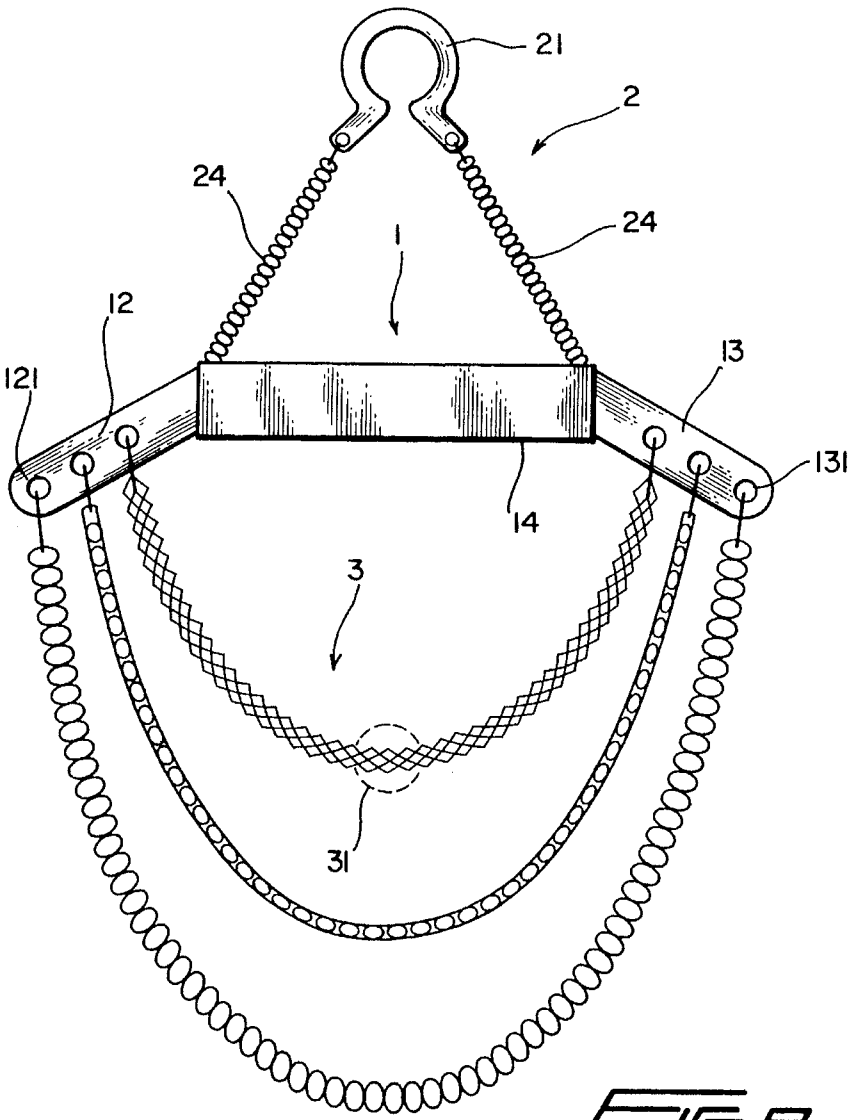
Figure 11:
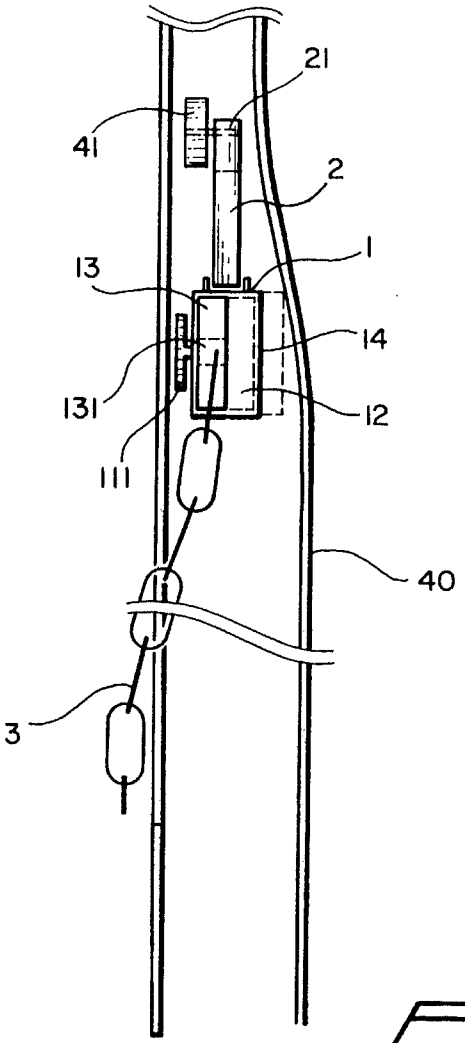
FIG. 11 is a side view of the tie holder shown in FIG. 10.
Figure 10:
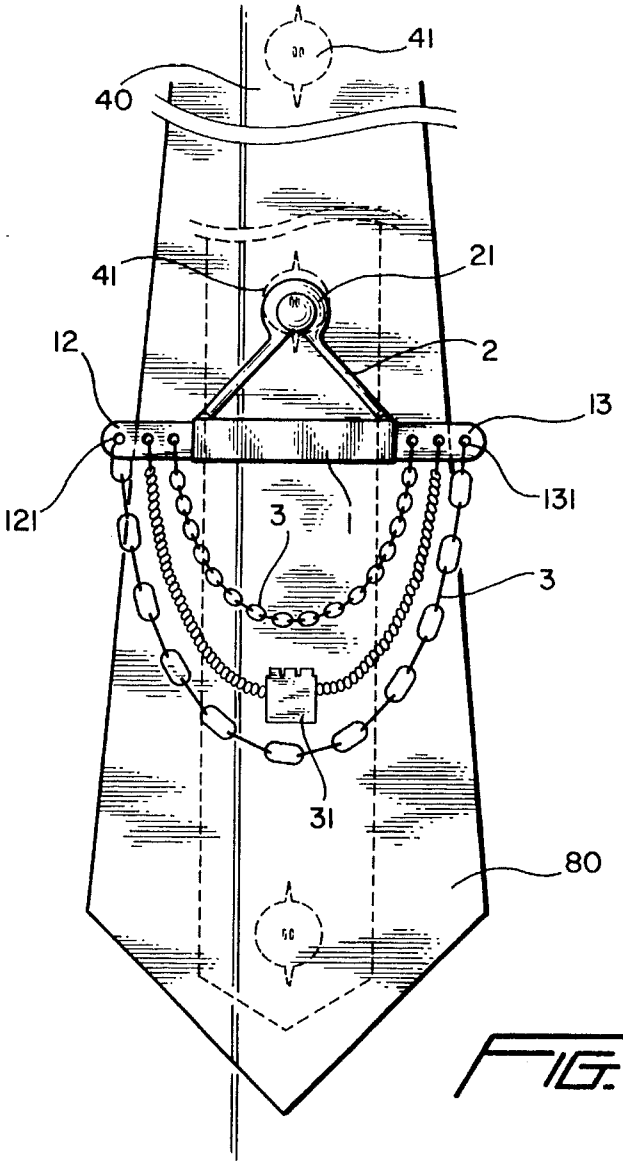
FIG. 10 shows the tie holder structure of the present invention in use.

With reference to FIGS. 2 and 3, the present invention is a multi-purpose adjustable tie holder structure, comprising a clasp means 1, a hanger 2 and an ornamental chain 3. The clasp means 1 is an adjustable central controlling body including of a gear shaft 11, a left arm 12, a right arm 13 and a shell 14. As shown in FIGS. 4 and 5, the shell 14 is only a hollow shell body. A clasp element of the known type may be securely fixed on an outer wall of the rear side of the shell 14. The front side of the shell 14 has a central through hole 141 for insertion of the gear shaft 11. The left arm 12 and the right arm 13 are accommodated within the elongated body of the shell 14 in such a way that they overlap and each have a lateral end portion extending from the corresponding lateral opening of the shell 14. Through holes 121 and 131 are respectively provided in the lateral end portions of the left arm 12 and the right arm 13 for connection with the ornamental chain 3. In the central surface where the left arm 12 and the right arm 13 overlap, a left opening 122 and a right opening 132 of a comparatively greater width are arranged. An upper rack element 123 is provided on an upper wall of the left opening 122, while a lower rack element 133 is provided on a lower wall of the right opening 132. The pitch and the number of teeth of the rack elements 123 and 133 should match so that when the gear shaft 11 rotates, synchronous reverse equidistant displacement may be performed. The gear shaft 11 is a short cylindrical body consisting of a rotary disk 111 and a gear cylinder 112 having teeth which match the upper and lower rack elements 123, 133. The gear shaft 11 is disposed in a space formed in the overlapping part of the left and right arms 12, 13, so that the teeth of the gear shaft 11 simultaneously mesh with the teeth of the rack elements 123, 133, thereby movement of the gear shaft 11 controls the left and right arms 12, 13 to perform synchronous reverse equidistant extension or retraction. Alternatively, the left arm 12 or the right arm 13 may be pulled out from or pushed in one side of the shell 14 so that both may perform synchronous reverse equidistant movements, as shown in FIG. 6. Referring back to FIGS. 2 and 3, the hanger 2 is an inverted horn-shaped fixed type structure provided on an upper rim of the clasp means 1. The hanger 2 has a head portion 21 at the top end thereof and which matches the diameter of shirt buttons. The hanger 2 further has frame elements 22 which are fixedly or movably connected to the upper rim of the clasp means 1. The head portion 21 of the hanger 2 may hook on to a button of the shirt to prevent the clasp means 1 from slipping off. The hanger 2 may be formed into a semi-fixed type or a flexible one. As shown in FIG. 7, a flexible hanger 23 is provided on the clasp means 1. The top portion of the hanger 23 is a soft flexible ring 231 connected to the central position of the clasp means 1 by means of a single wire rod. As shown in FIGS. 8 and 9, the head portion 21 is connected to the upper rim of the clasp means 1 by two chains 24. The length of the ornamental chain 3 is determined by the distance between two adjacent through holes 121, 131, and an ornament 31 may be fixed onto the ornamental chain 3 for further enhancement. Several ornamental chains 3 may be provided and, by means of adjusting the left and right arms 12, 13 of the clasp means 1, the length of the ornamental chains 3 may be adjusted to match the width of the necktie. Besides, all the ornamental chains 3 or only one or two of them may be selectively exposed on the necktie for variety's sake. The ornament 31 may also be selectively exposed or concealed. With reference to FIGS. 10 and 11, the clasp element at the rear side of the clasp means 1 is used to hold the necktie in place (illustration thereof is omitted in the drawings since such is a known technique). Alternatively, the head portion 21 or the flexible ring 231 may be suspended by a button 41 of the shirt 40 to achieve similar effects. By adjusting the left and right arms 12, 13 of the clasp means 1, the ornamental chains 3 may be selectively wrapped around the necktie 80, and if the necktie 80 is too wide or too narrow, the length of the ornamental chains 3 may be adjusted to match the width of the necktie 80, as shown in FIG. 12. In the present invention, the tie holder structure may be used to keep the necktie in place by means of the clasping means or the head portion of the hanger; additionally, the present invention provides for simple adjustment of the length of the ornamental chains so that the necktie may be appropriately wrapped around by the chains.

Although the present invention has been illustrated and described with reference to the preferred embodiment thereof, it should be understood that it is in no way limited to the details of such embodiment but is capable of numerous modifications within the scope of the appended claims.

What is claimed is:

1. A multi-purpose tie holder structure comprising:

a hollow shell having first and second open ends and first and second spaced longitudinal sides, said first longitudinal side being provided with a substantially, centrally located through hole;

first and second elongated arm members movably mounted in a spaced, side-by-side relationship within said shell with the first arm member being located along said first longitudinal side and said second arm member being located along said second longitudinal side, each of said first and second arm members including a main body portion and an end portion adapted to project out of a respective one of said first and second open ends of said shell, each end portion being provided with at least one through holes, the main body portion of each of said arm members including a longitudinally extending opening in the form of a slot arranged entirely within an outer periphery of a respective one of said arm members, each of said slots being defined, at least in part, by upper and lower surfaces, the upper surface of the slot in one of said arm members being formed with a longitudinally extending rack of gear teeth and the lower surface of the slot in the other of said arm members being formed with another longitudinally extending rack of gear teeth;

a gear shaft including a plurality of circumferentially spaced gear teeth rotatably attached to said shell and extending into said shell through said centrally located through hole, said gear shaft further projecting through each of the slots formed in said first and second arm members with the gear teeth of said gear shaft being interengaged with the rack of gear teeth of each of said first and second arm members such that longitudinal movement of either of said arm members relative to said shell will automatically result in a corresponding, synchronous movement of the other of said arm members;

at least one chain extending between and attached at a corresponding one of the through holes provided in said first and second arm members; and means for attaching said tie holder to an article of clothing, said attaching means being secured to said shell.

2. The multi-purpose tie holder structure as claimed in claim 1, wherein said attaching means comprises a hanger connected to said shell.

3. A multi-purpose tie holder structure as claimed in claim 2, wherein said hanger is an inverted horn-shaped structure having a head portion and a frame element, said head portion matching the diameter of a shirt button so that said hanger may be suspended by said button, said frame element being connected to an upper side of said shell.

4. A multi-purpose tie holder structure as claimed in claim 3, wherein said hanger is a flexible wire hanger having a flexible ring connected to a single wire rod.

5. A multi-purpose tie holder structure as claimed in claim 3, wherein said hanger comprises a head portion connected to chain elements.

* * * * *